US005839308A

United States Patent [19]

Eizen et al.

[11] Patent Number: 5,839,308

[45] **Date of Patent: *Nov. 24, 1998**

[54] LOCKING APPARATUS

[75] Inventors: Noach Eizen, Rishon Lezion; Dani Markbreit, Azor, both of Israel

[73] Assignee: Mul-T-Lock Ltd., Yavne, Israel

[ * ] Notice: The term of this patent shall not extend beyond the expiration date of Pat. No. 5,520,035.

[21] Appl. No.: 961,258

[22] Filed: Oct. 30, 1997

Related U.S. Application Data

[63] Continuation of Ser. No. 613,664, Mar. 11, 1996, Pat. No. 5,784,910, which is a continuation of Ser. No. 340,352, Nov. 14, 1994, Pat. No. 5,520,035, which is a continuation of Ser. No. 9,069, Jan. 26, 1993, abandoned.

[30] Foreign Application Priority Data

Jan. 8, 1993 [IL] Israel ..... 104349

[51] Int. Cl.[6] ..... E05B 19/08; E05B 27/06

[52] U.S. Cl. ..... 70/358; 70/359; 70/395; 70/398; 70/409

[58] Field of Search ..... 70/398, 359, 409, 70/411, 414, 358, 394, 395, 399, 401, 406

[56] References Cited

U.S. PATENT DOCUMENTS

| | | | |
|---|---|---|---|
| 939,679 | 11/1909 | Freud | 70/411 |
| 1,382,826 | 6/1921 | Dove | 70/398 |
| 1,438,839 | 12/1922 | Levey | 70/460 |
| 2,440,428 | 4/1948 | Best | 70/409 |
| 2,587,037 | 2/1952 | Glubiak | 70/414 |
| 3,877,267 | 4/1975 | Harris, Jr. | 70/358 |
| 4,377,082 | 3/1983 | Wolter | 70/409 X |
| 4,662,200 | 5/1987 | Borda | 70/411 |
| 4,667,495 | 5/1987 | Girard et al. | 70/398 |
| 5,123,268 | 6/1992 | Eizen | 70/359 |
| 5,131,247 | 7/1992 | Hsu | 70/358 |
| 5,170,651 | 12/1992 | Errani | 70/493 |
| 5,520,035 | 5/1996 | Eizen et al. | 70/358 |

FOREIGN PATENT DOCUMENTS

| | | | |
|---|---|---|---|
| 0154755 | 9/1985 | European Pat. Off. . | |
| 431550 | 6/1991 | European Pat. Off. . | |
| 436496 | 7/1991 | European Pat. Off. . | |
| 0472495 | 2/1992 | European Pat. Off. . | |
| 2492872 | 4/1982 | France . | |
| 2521201 | 8/1983 | France . | |
| 2522053 | 8/1983 | France . | |
| 2561294 | 9/1985 | France . | |
| 2619149 | 2/1989 | France | 70/398 |
| 2561293 | 2/1992 | France . | |
| 154306 | 9/1904 | Germany | 70/409 |
| 196873 | 3/1908 | Germany | 70/411 |
| 252237 | 10/1912 | Germany . | |
| 633936 | 8/1936 | Germany | 70/398 |
| 1176516 | 8/1964 | Germany . | |
| 2752550 | 6/1978 | Germany | 70/359 |
| 3424307 | 1/1985 | Germany . | |
| 2161204 | 1/1986 | United Kingdom | 70/358 |
| WO91/10796 | 7/1991 | WIPO . | |

*Primary Examiner*—Lloyd A. Gall
*Attorney, Agent, or Firm*—Nixon & Vanderhye P.C.

[57] ABSTRACT

A key blank including a generally elongate shaft portion defining a key combination surface adapted to have formed thereon key cuts which define a key combination, the key blank including a movable pin element retained within the elongate shaft portion, the movable pin element being displaceable in a single direction, outwardly from the key combination surface.

11 Claims, 16 Drawing Sheets

LOCKING APPARATUS

REFERENCE TO RELATED APPLICATIONS

This application is a continuation of application Ser. No. 08/613,664,filed Mar. 11, 1996,now U.S. Pat. No. 5,784, 910, which is a continuation of Ser. No. 08/340,352, filed Nov. 14, 1994, now U.S. Pat. No. 5,520,035, issued May 28, 1996, which is a continuation of application Ser. No. 08/009, 069, filed Jan. 26, 1993, now abandoned.

FIELD OF THE INVENTION

The present invention relates to locking apparatus generally and more particularly to key blanks, keys, and locks actuated thereby.

BACKGROUND OF THE INVENTION

A great variety of key blanks and associated locks are known. In the prior art, key blanks include a generally elongate unitary key cut-bearing portion with which is associated a key head.

There is known and described in U.S. Pat. 4,377,082 a key blank available from Dom of Germany including a floating ball which is located at the center of the key cut-bearing portion and engages additional blocking pins off-axis with respect to the conventional pin tumblers.

There is also known and described in French Patent applications 82.01.905 and 84.03.944 and EPO published application 84.400.694.0 a key blank available from Vachette of France including a transverse sliding pin, which engages a cam in a corresponding lock.

SUMMARY OF THE INVENTION

The present invention seeks to provide an improved key blank, key and lock.

There is thus provided in accordance with a preferred embodiment of the present invention a key blank including a generally elongate shaft portion defining a key combination surface adapted to have formed thereon key cuts which define a key combination, the key blank including a movable pin element retained within the elongate shaft portion, the movable pin element being displaceable in a single direction, outwardly from the key combination surface.

There is also provided in accordance with a preferred embodiment of the present invention a key blank including a generally elongate shaft portion defining a key combination surface adapted to have formed thereon at a subsequent time, a plurality of key cuts arranged in a row, which key cuts define a key combination, the key blank including a movable pin element retained within the elongate shaft portion, the movable pin element arranged to lie along the row of key cuts.

There is additionally provided in accordance with a preferred embodiment of the present invention a key blank including a generally elongate shaft portion defining a key combination surface adapted to have formed thereon key cuts which define a key combination, the key blank including a movable pin element retained within the elongate shaft portion, the movable pin element being selectable configurable to provide multiple combinations.

In accordance with one embodiment of the present invention, the movable pin element is configurable prior to its insertion in the key blank.

In accordance with another preferred embodiment of the present invention, the movable pin element may be configurable following its insertion in the key blank. Preferably the configuration of the movable pin element can be carried out using the same key cutting apparatus used for cutting the remaining key cuts on the key blank.

Further in accordance with a preferred embodiment of the present invention, the key blank also comprises a retractable cover member for covering part of the shaft including the movable pin element, when it is not inserted in a lock keyway.

Preferably, the key blank is a reversible key blank arranged to have formed thereon a pair of opposite key combination surfaces and includes a pair of movable pin elements, each associated with one of the key combination surfaces.

In accordance with a preferred embodiment of the invention the pair of movable pin elements may have different configurations. In such a case, depending on the orientation of the key it is operative to operate two different and mutually exclusive master key systems.

There is additionally provided in accordance with a preferred embodiment of the present invention a key including a generally elongate shaft portion defining a key combination surface having formed thereon key cuts which define a key combination, the key including a movable pin element retained within the elongate shaft portion, the movable pin element being displaceable in a single direction, outwardly from the key combination surface.

There is also provided in accordance with a preferred embodiment of the present invention a key including a generally elongate shaft portion defining a key combination surface having formed thereon a plurality of key cuts arranged in a row, which key cuts define a key combination, the key blank including a movable pin element retained within the elongate shaft portion and arranged to lie along the row of key cuts.

There is additionally provided in accordance with a preferred embodiment of the present invention a key including a generally elongate shaft portion defining a key combination surface having formed thereon key cuts which define a key combination, the key including a movable pin element retained within the elongate shaft portion, the movable pin element being configured in one of a plurality of possible combinations in order to provide multiple combinations.

Further in accordance with a preferred embodiment of the present invention, the key also comprises a retractable cover member for covering part of the shaft including the movable pin element, when it is not inserted in a lock keyway.

Preferably, the key is a reversible key having formed thereon a pair of opposite key combination surfaces and includes a pair of movable pin elements, each associated with one of the key combination surfaces.

Additionally in accordance with a preferred embodiment of the present invention there is provided a lock cylinder configured to be operated by a key including a generally elongate shaft portion defining a key combination surface having formed thereon key cuts which define a key combination, a movable pin element retained within the elongate shaft portion and being displaceable in a single direction, outwardly from the key combination surface, the lock comprising:

- a housing;
- a plug disposed in the housing, arranged for rotation relative thereto and defining a keyway;
- a first plurality of chambers formed in the housing and a second plurality of chambers formed in the plug on one side of the keyway and being arranged such that each one of the first plurality of chambers extends coaxially with a corresponding one of the second plurality of chambers, when the plug is in a first rotational orientation relative to the housing;

first pin assemblies being disposed in the first plurality of chambers and second pin assemblies disposed in the second plurality of chambers; a third pin assembly being disposed in the plug on a side of the keyway opposite to that of the second pin assemblies and being operative to urge said movable pin element outwardly into engagement with one of the second pin assemblies.

Further in accordance with a preferred embodiment of the present invention there is provided a lock cylinder configured to be operated by a key including a generally elongate shaft portion defining a key combination surface having formed thereon a row of key cuts which define a key combination, a movable pin element retained within the elongate shaft portion and being arranged to lie along the row of key cuts, the lock comprising:

a housing;

a plug disposed in the housing, arranged for rotation relative thereto and defining a keyway;

a first plurality of chambers formed in the housing and a second plurality of chambers formed in the plug on one side of the keyway and being arranged such that each one of the first plurality of chambers extends coaxially with a corresponding one of the second plurality of chambers, when the plug is in a first rotational orientation relative to the housing;

first pin assemblies being disposed in the first plurality of chambers and second pin assemblies disposed in the second plurality of chambers; a third pin assembly being disposed in the plug on a side of the keyway opposite to that of the second pin assemblies and being operative to urge said movable pin element outwardly into engagement with one of the second pin assemblies.

Further in accordance with a preferred embodiment of the present invention there is provided a lock cylinder configured to be operated by a key including a generally elongate shaft portion defining a key combination surface having formed thereon a row of key cuts which define a key combination, a movable pin element retained within the elongate shaft portion and being configured in one of a plurality of possible combinations in order to provide multiple combinations, the lock comprising:

a housing;

a plug disposed in the housing, arranged for rotation relative thereto and defining a keyway;

a first plurality of chambers formed in the housing and a second plurality of chambers formed in the plug on one side of the keyway and being arranged such that each one of the first plurality of chambers extends coaxially with a corresponding one of the second plurality of chambers, when the plug is in a first rotational orientation relative to the housing;

first pin assemblies being disposed in the first plurality of chambers and second pin assemblies disposed in the second plurality of chambers; a third pin assembly being disposed in the plug on a side of the keyway opposite to that of the second pin assemblies and being operative to urge said movable pin element outwardly into engagement with one of the second pin assemblies.

The lock cylinder may be employed in any suitable kind of lock, such as a door lock, a padlock and gear-shift lock.

In accordance with a preferred embodiment of the present invention, the movable pin element is formed with a recess on its surface facing in the same direction as the key combination surface.

Additionally in accordance with a preferred embodiment of the present invention, the movable pin element may operate with telescopic plug pins.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1A:
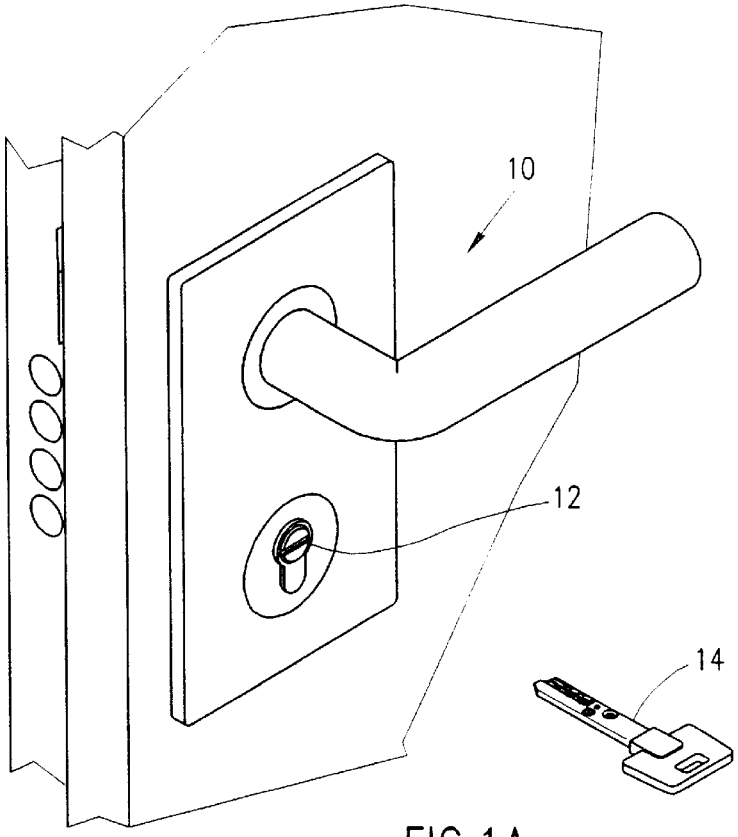
Figs. 1A and 1B are pictorial illustrations showing two types of locks and keys constructed and operative in accordance with a preferred embodiment of the present invention.
Figure 1B:
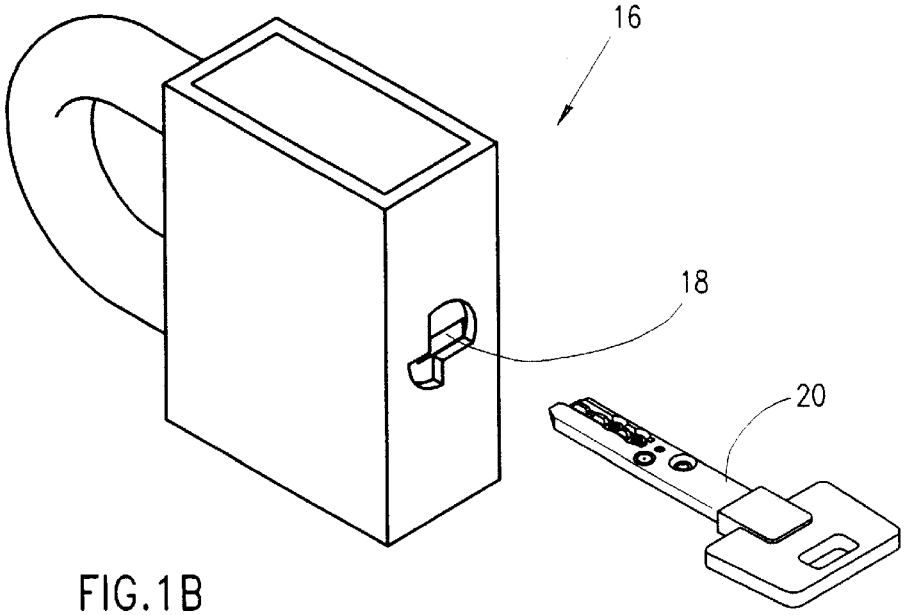

Reference is now made to FIGS. 1A and 1B which illustrate a key and cylinder lock constructed and operative in accordance with a preferred embodiment of the present invention. FIG. 1A illustrates a door lock 10 employing a cylinder 12 and key 14 according to the present invention and FIG. 1B illustrates a padlock 16 employing a cylinder 18 and key 20 according to the present invention.

Broadly speaking, the key and the key blank used to produce the key are characterized in that they include at least one and preferably two movable pin elements having at least one of the following characteristics:

The pin element is arranged for movement in only a single direction perpendicular to the plane of the key and the lock keyway.

The pin element is non-rotatable with respect to the remainder of the key.

The pin element is selectable configurable so as to define a plurality of different permutations.

The pin element includes a recess.

The pin element is arranged to lie along a row of key cuts conventionally formed in the key and thus operates a conventional plug pin of the lock.

A pair of pin elements having different configurations are associated with opposite key combination surfaces, thus providing a double function key and key blank.

These and other features of the key blank, key and lock of the present invention will be described hereinbelow with reference to the remainder of the drawings in order to provide a comprehensive picture of the novel features of the invention which is applicable to any suitable cylinder lock context.

Figure 2A:
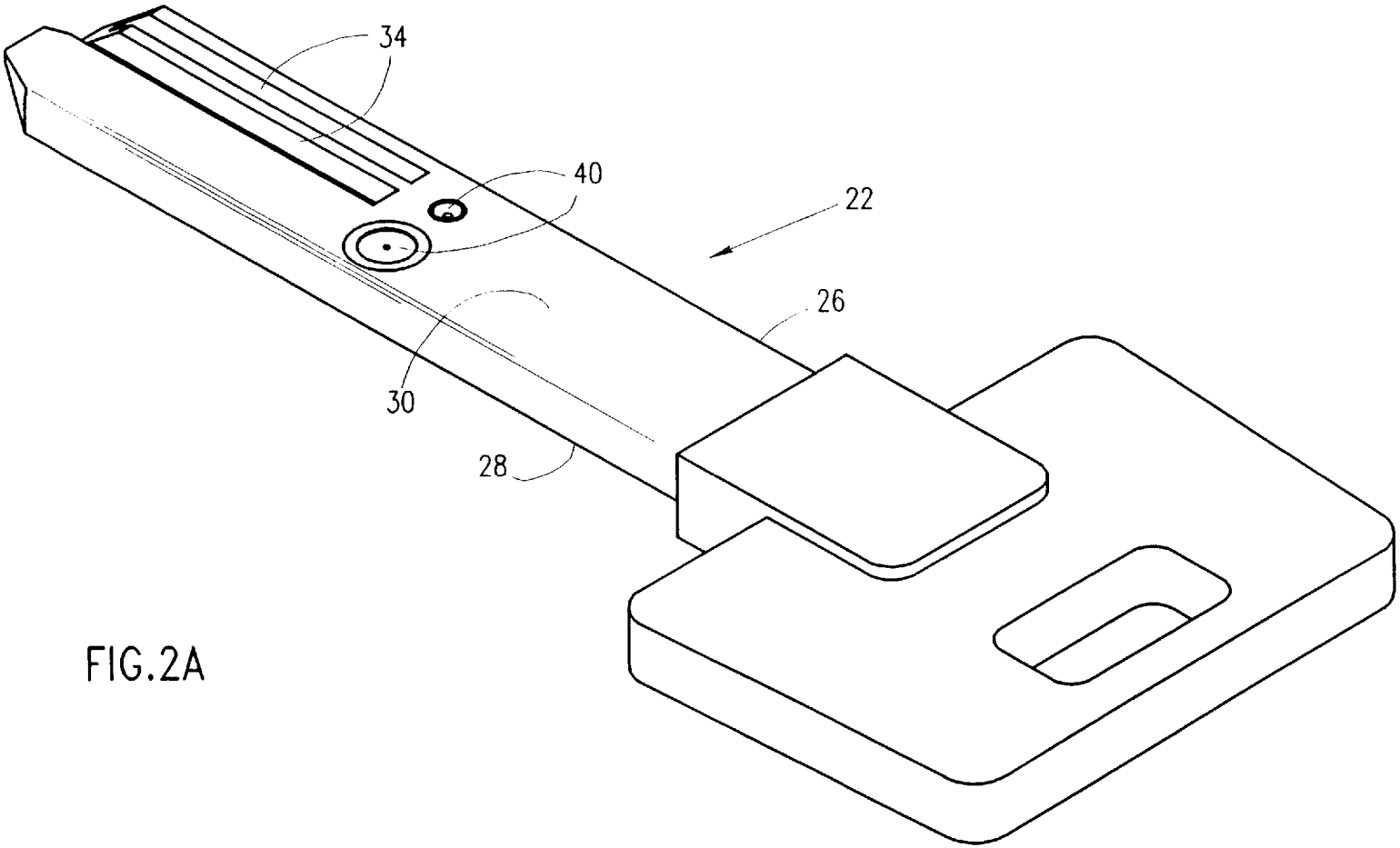
Figs. 2A and 2B are pictorial illustrations of a key blank and a key constructed and operative in accordance with a preferred embodiment of the present invention.
Figure 2B:
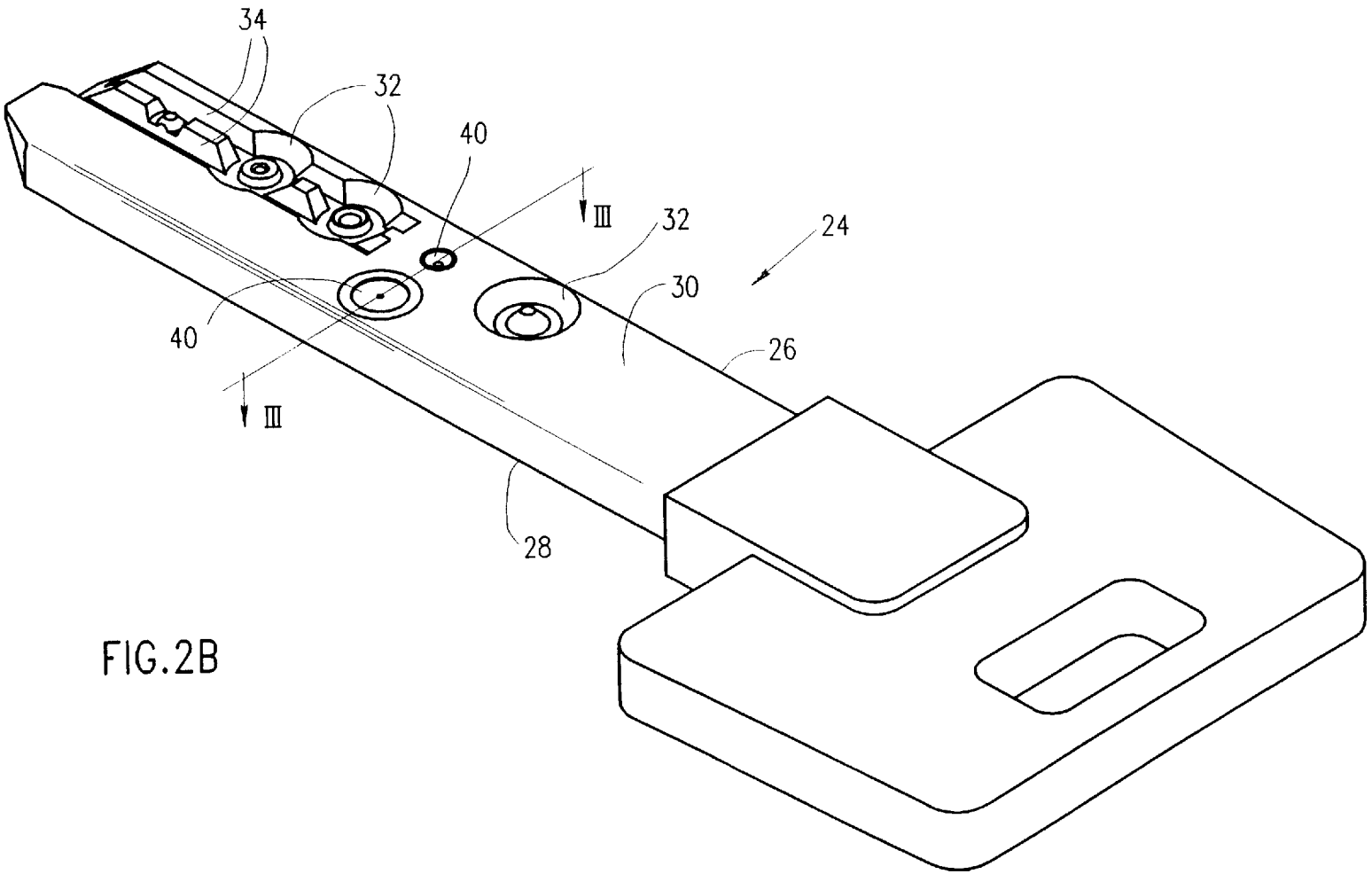

Reference is now made to FIGS. 2A and 2B which illustrate a key blank 22 and key 24 constructed and operative in accordance with a preferred embodiment of the present invention. The common features of the key blank 22 and the key 24 will now be described using identical reference indications.

Both the key blank 22 and the key 24 comprise a generally elongate shaft portion 26, preferably, but not necessarily including first and second opposite planar surfaces 28 and 30, at least one of which constitutes a key combination surface 30 which is arranged to have formed thereon a plurality of key cuts 32, which define a lock combination in a conventional manner. When the key blank 22 and the key 24 define reversible keys, both of planar surfaces 28 and 30 constitute key combination surfaces.

Preferably, each key combination surface 30 also defines elongate keyway guides 34, which fit in configuration to protrusions defined in the interior of the keyway in the corresponding lock, which will described hereinbelow. Some or all of key cuts 32 may be formed over guides 34. Between guides 34 there is defined a keyway guide axis.

In accordance with a preferred embodiment of the present invention a movable pin element 40 is retained in shaft portion 26 for motion, preferably in a single direction only, perpendicular to, i.e. in and out of the key combination surface 30. In reversible key blanks, as shown in FIGS. 2A and 2B, a pair of oppositely directed movable pin elements 40 are retained in shaft portion 26, each for operative association with a key combination surface.

In accordance with a preferred embodiment of the invention the pair of oppositely-directed movable pin elements may have different configurations. In such a case, depending on the orientation of the key it is operative to operate two different and mutually exclusive master key systems, each of which is operated by a different pin element configuration.

Reference is now made to FIGS. 3A–3D which are taken along the lines III—III in FIG. 2B and illustrate four different examples of movable pin mountings and configurations.

Figure 3A:
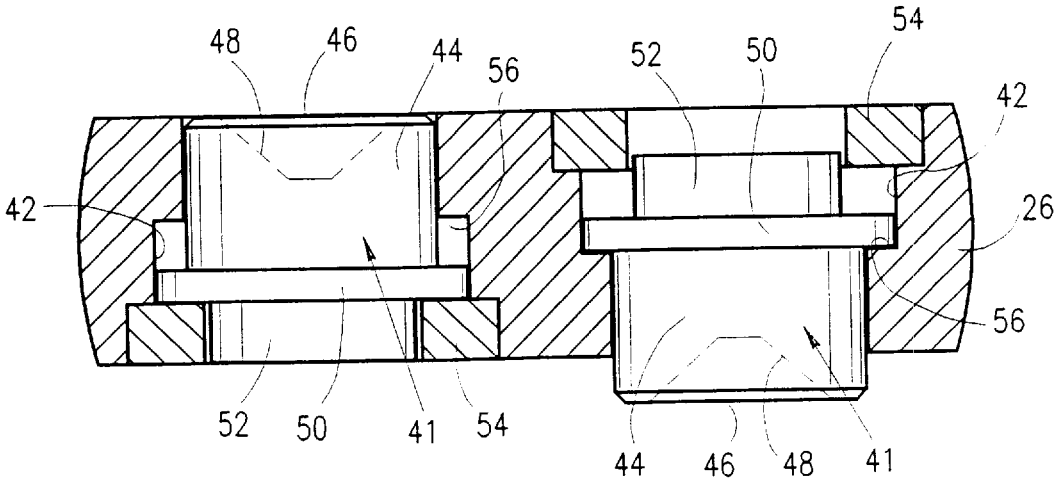
FIGS. 3A, 3B, 3C and 3D are sectional illustrations taken along lines III—III of FIG. 2B, and illustrating four different examples of the construction and mounting of movable pin elements in a,key.

In the embodiment of FIG. 3A, the shaft 26 is formed with a two step bore 42 for each pin element 41 and the pin element 41 is preferably integrally formed with a plug pin engaging portion 44 having a facing end 46 which can be selectable configured to provide various combinations, preferably a socket 48 of a desired depth; a broadened intermediate portion 50 and a narrowed pusher pin engagement portion 52. A retaining ring 54 preferably retains the pin element 40 against disengagement from the shaft portion 26 in one direction and engagement of intermediate portion 50 with a shoulder 56 retains the pin element 41 against disengagement from shaft portion 26 in the other direction.

Figure 3B:
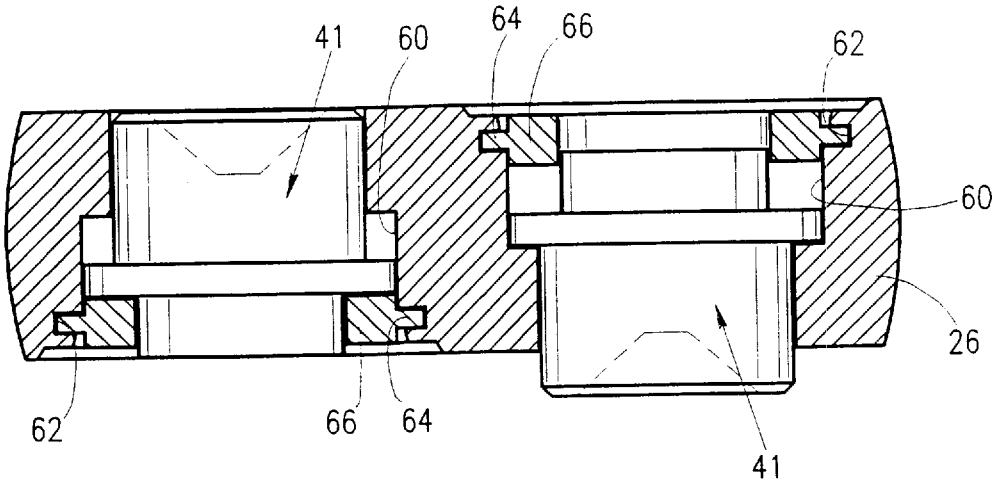

In the embodiment of FIG. 3B the same pin element 41 as in the embodiment of FIG. 3A may be employed. Here, however, a single shoulder bore 60 is provided, above a peripheral recess 62, which accommodates a narrow peripheral protrusion 64 of a sealing ring 66.

Figure 3C:
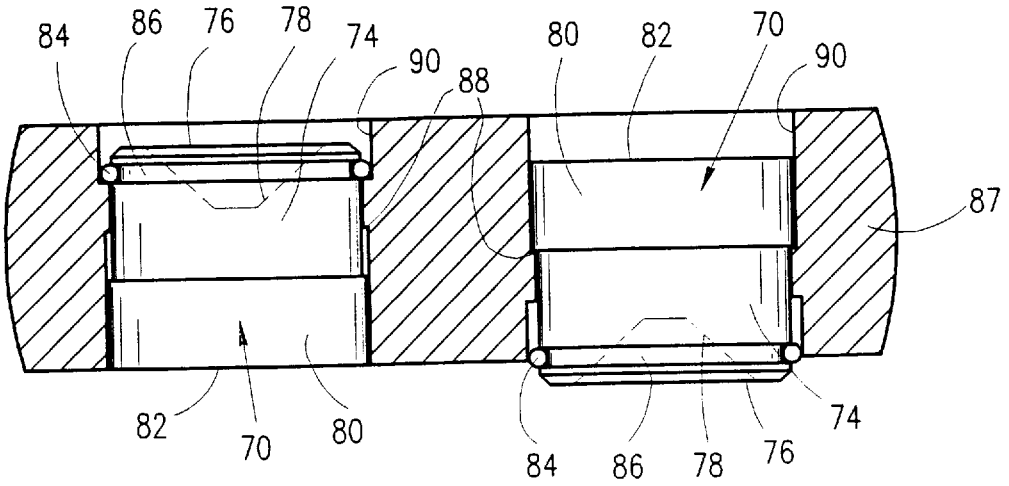

In the embodiment of FIG. 3C, a different type of pin element 70 is shown and is preferably integrally formed with a plug pin engaging portion 74 having a facing end 76 which can be selectable configured to provide various combinations, preferably a socket 78 of a desired depth and a broadened portion 80 defining a pusher pin engagement surface 82. A retaining ring 84 is partially seated in a peripheral key cut 86 formed in portion 74 adjacent end 76 and preferably retains the pin element 70 against disengagement from the shaft portion 87 in one direction and engagement of a shoulder between portions 74 and 80 of pin element 70 with a corresponding shoulder 88 in a bore retains the pin element 70 against disengagement from shaft portion 87 in the other direction. Bore 90 also defines a broadened portion which accommodates retaining ring 84.

Figure 3D:
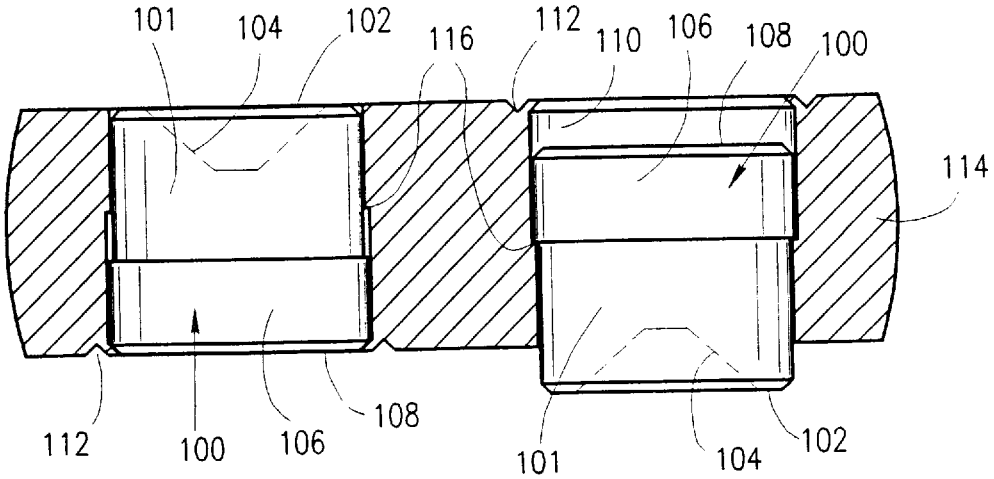

In the embodiment of FIG. 3D, yet another type of pin element 100 is shown and is preferably integrally formed with a plug pin engaging portion 101 having a facing end 102 which can be selectable configured to provide various combinations, preferably a socket 104 of a desired depth, and a broadened portion 106 defining a pusher pin engagement surface 108. No retaining ring is required inasmuch as the top of a bore 110 is swaged as indicated at reference numeral 112 to retain the pin element 100 against disengagement from the shaft portion 114 in one direction. Engagement of a shoulder between portions 101 and 106 of pin element 100 with a corresponding shoulder 116 in bore 110 retains the pin element 100 against disengagement from shaft portion 114 in the other direction.

Figure 4:
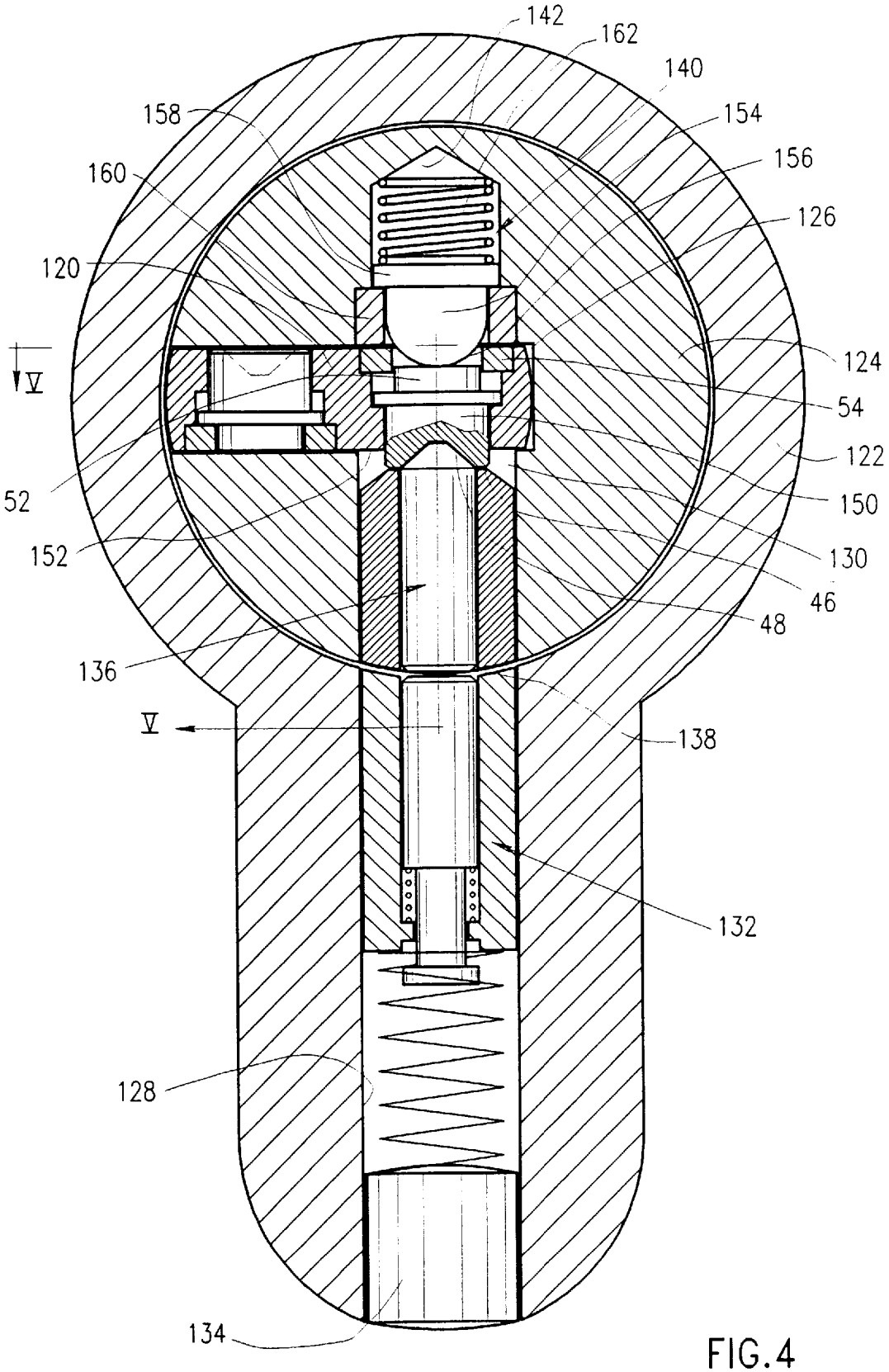
FIG. 4 is a sectional illustration of a lock cylinder having a key inserted therein, constructed and operative in accordance with a preferred embodiment of the present invention.
Figure 5:
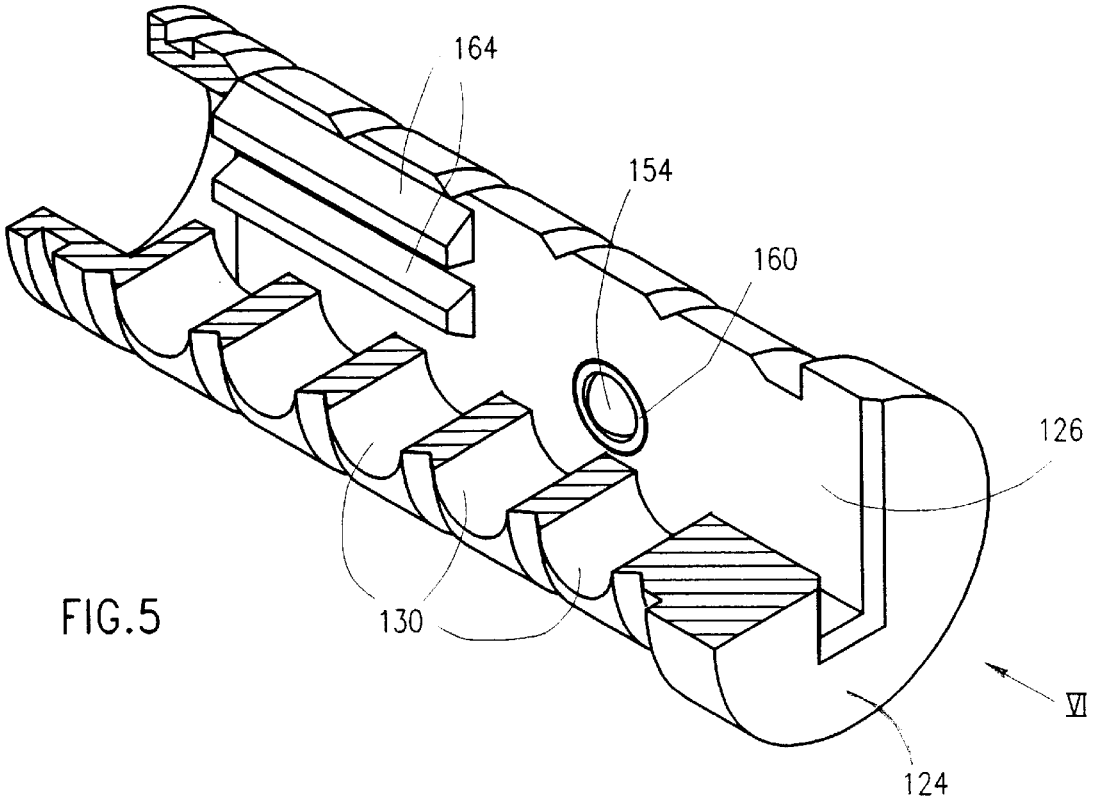
FIG. 5 is a partially cut-way pictorial illustration of part of the plug of the lock of FIG. 4, taken along lines V—V of FIG. 4.
Figure 6:
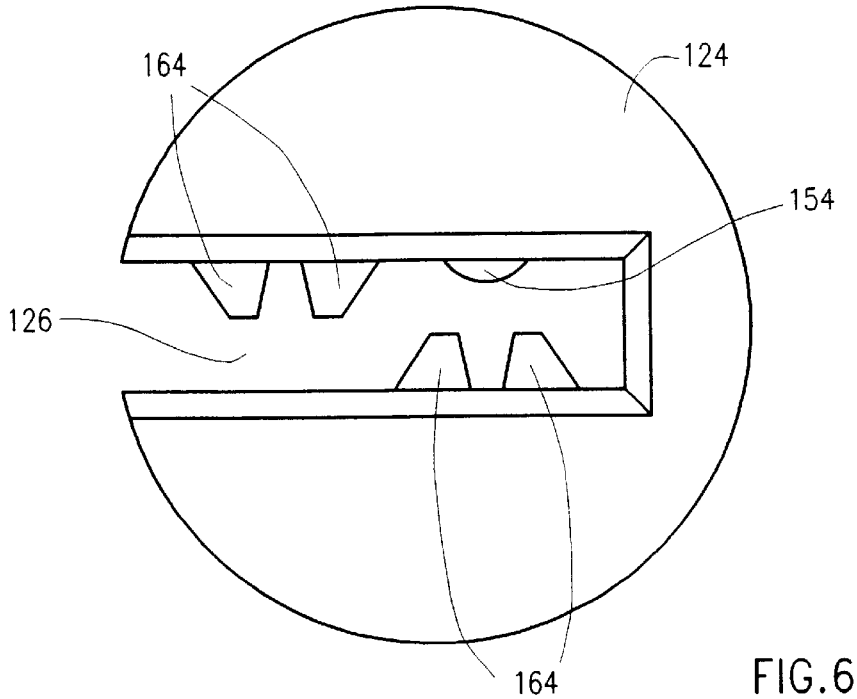
Fig. 6 is a planar illustration of the keyway of the plug of FIG. 5, taken along the line VI in FIG. 5.

Reference is now made to FIGS. 4, 5 and 6, which illustrate a lock cylinder in operative engagement with a key constructed in accordance with a preferred embodiment of the present invention. It is to be appreciated that although the key illustrated at reference numeral 120 in FIG. 4 is the embodiment shown in FIG. 3A, any suitable embodiment of key may be employed.

The lock cylinder of FIGS. 4, 5 and 6 comprises a housing 122 and a plug 124 which is arranged for rotation relative thereto and defining a keyway 126.

A first plurality of chambers 128 are formed in the housing 122 and a second plurality of chambers 130 are formed in the plug on one side of the keyway and are arranged such that each one of the first plurality of chambers 128 extends coaxially with a corresponding one of the second plurality of chambers 130, when the plug is in a first rotational orientation relative to the housing, as shown in FIG. 4.

A plurality of first pin assemblies 132, which are preferably telescopic pin assemblies having a plurality of concentric pin portions as shown including a spring, are preferably disposed in the first plurality of chambers 128 and are retained therein by plugs 134. A plurality of second pin assemblies 136, which are preferably telescopic pin assemblies having a plurality of concentric pin portions as shown, are disposed in the second plurality of chambers 130. A shear line 138 is defined between the facing surfaces of the respective pluralities of first and second pin assemblies 132 and 136, when the proper key is located in its proper location in the keyway 126 in engagement with the second pin assemblies.

In accordance with a preferred embodiment of the present invention a third pin assembly 140 is disposed in a suitable single shoulder bore 142 in the plug 124 on a side of the keyway 126 opposite to that of the second pin assemblies 130 and is operative to urge a movable pin element 150 outwardly from the key combination surface 152 of the key 120 into operative engagement with one of the second pin assemblies 136. Alternatively, the movable pin element 150 may operate against an additional pin assembly which is not normally found in conventional cylinders.

In the illustrated embodiment, the movable pin element 150 may be identical to pin element 41 in the embodiment of FIG. 3A. The third pin assembly 140 preferably includes a pusher pin 154 having a rounded forward surface 156 and a broadened end portion 158, which is retained against disengagement from plug 124 by a retaining ring 160. A spring 162, which is stronger than the spring of pin assembly 132, urges pusher pin 154 forwardly into displacing engagement with portion 52 of pin element 150, thus urging pin element 41 into operative engagement with one of the second pin assemblies 136, as shown.

Key guide protrusions 164 are illustrated in FIGS. 5 and 6.

Figure 7A:
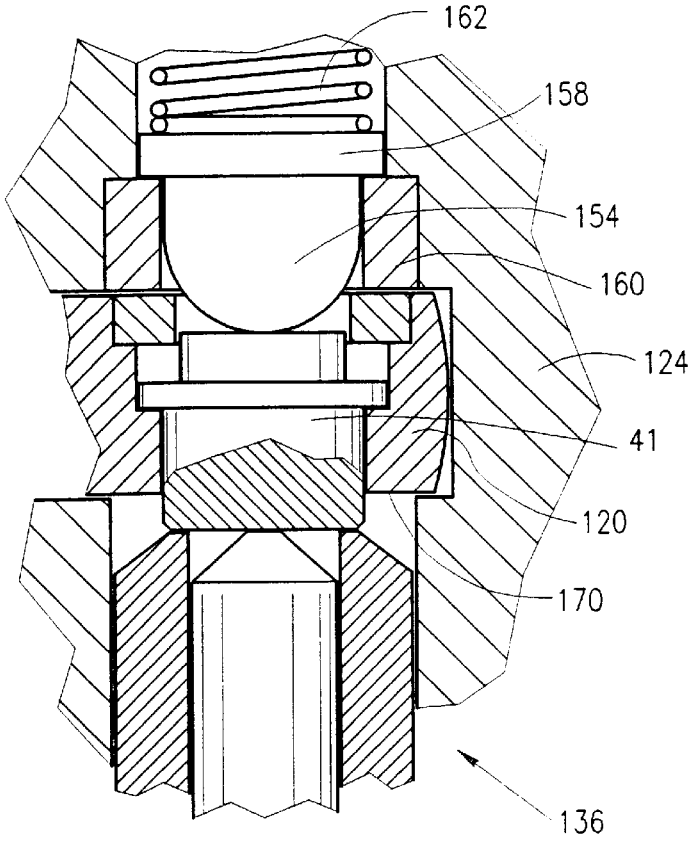
FIGS. 7A and 7B are partially cut away sectional illustrations of the operation of two differently configured movable pins, in engagement with telescoping plug pins in accordance with a preferred embodiment of the present invention.
Figure 7B:
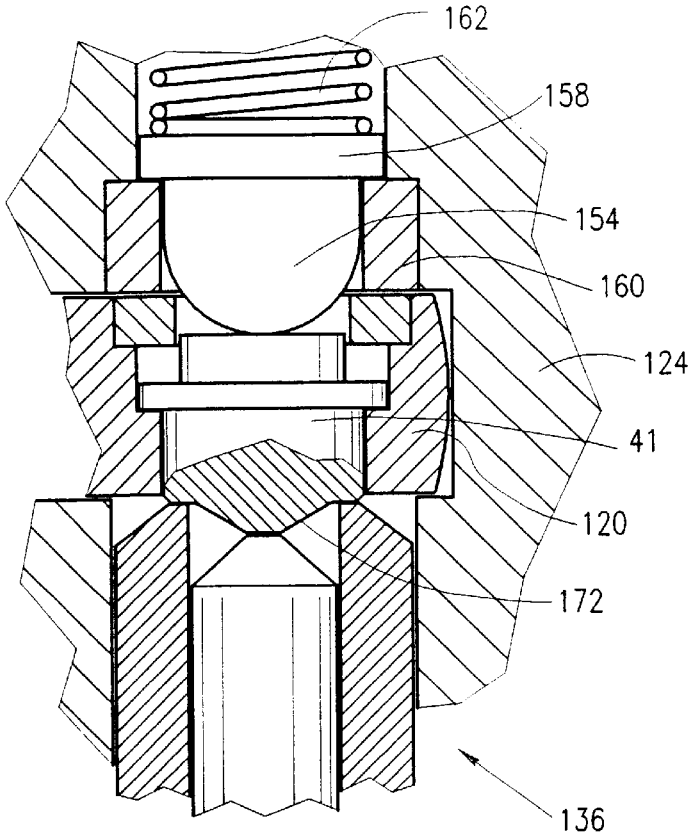

FIG. 4 illustrates pin 41 having a socket 48 formed at surface 46 thereof. FIGS. 7A and 7B illustrate other possible configurations of the forward surface 46 of pin 41, which enable various lock combinations to be realized thereby. In FIG. 7A, the forward surface is flat, as indicated by reference numeral 170. In FIG. 7B, the forward surface is a combination recess and central protrusion. It is appreciated that any other suitable surface configuration may be provided.

Figure 8A:
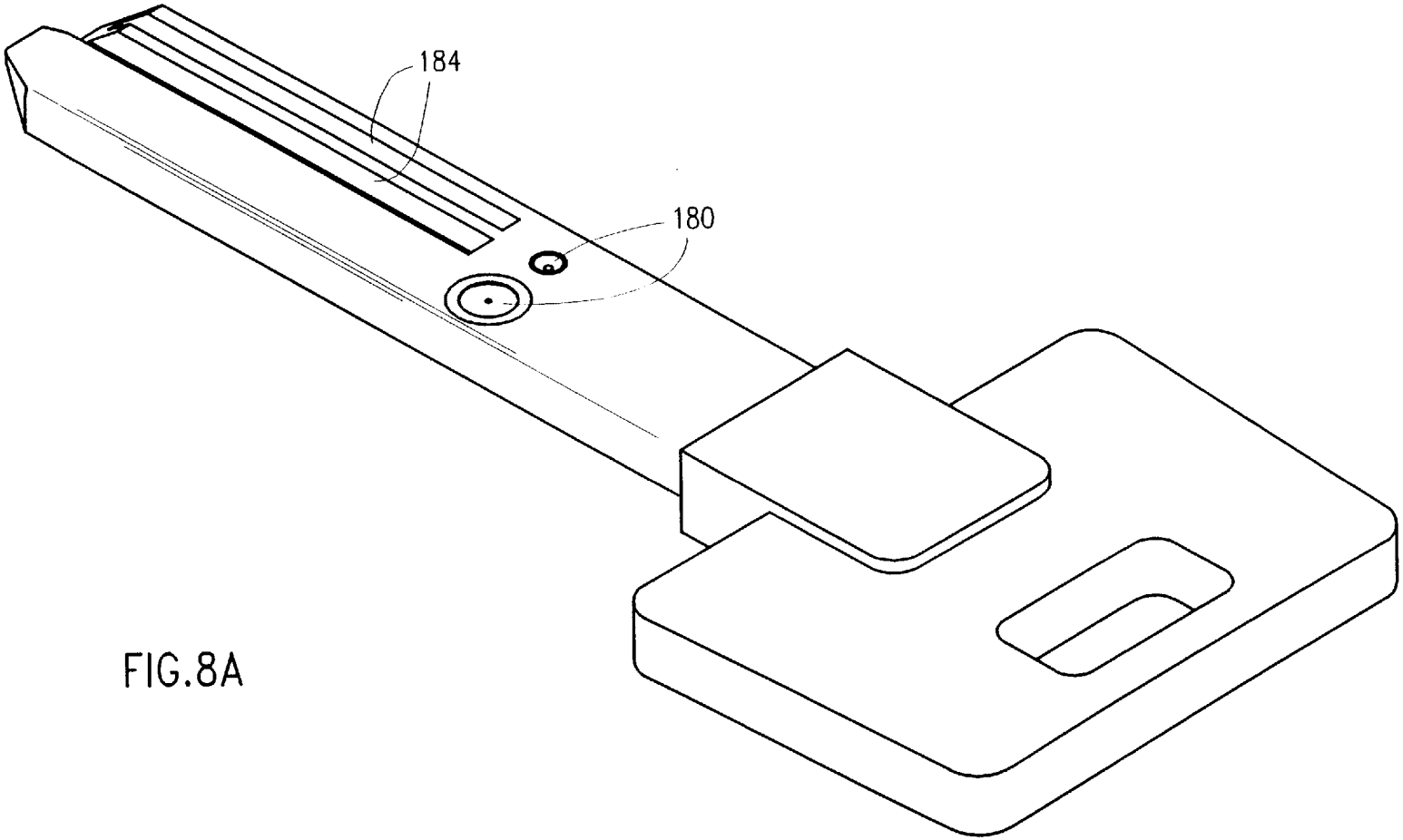
FIGS. 8A and 8B are pictorial illustrations of a key blank and a key constructed and operative in accordance with a preferred embodiment of the present invention.
Figure 8B:
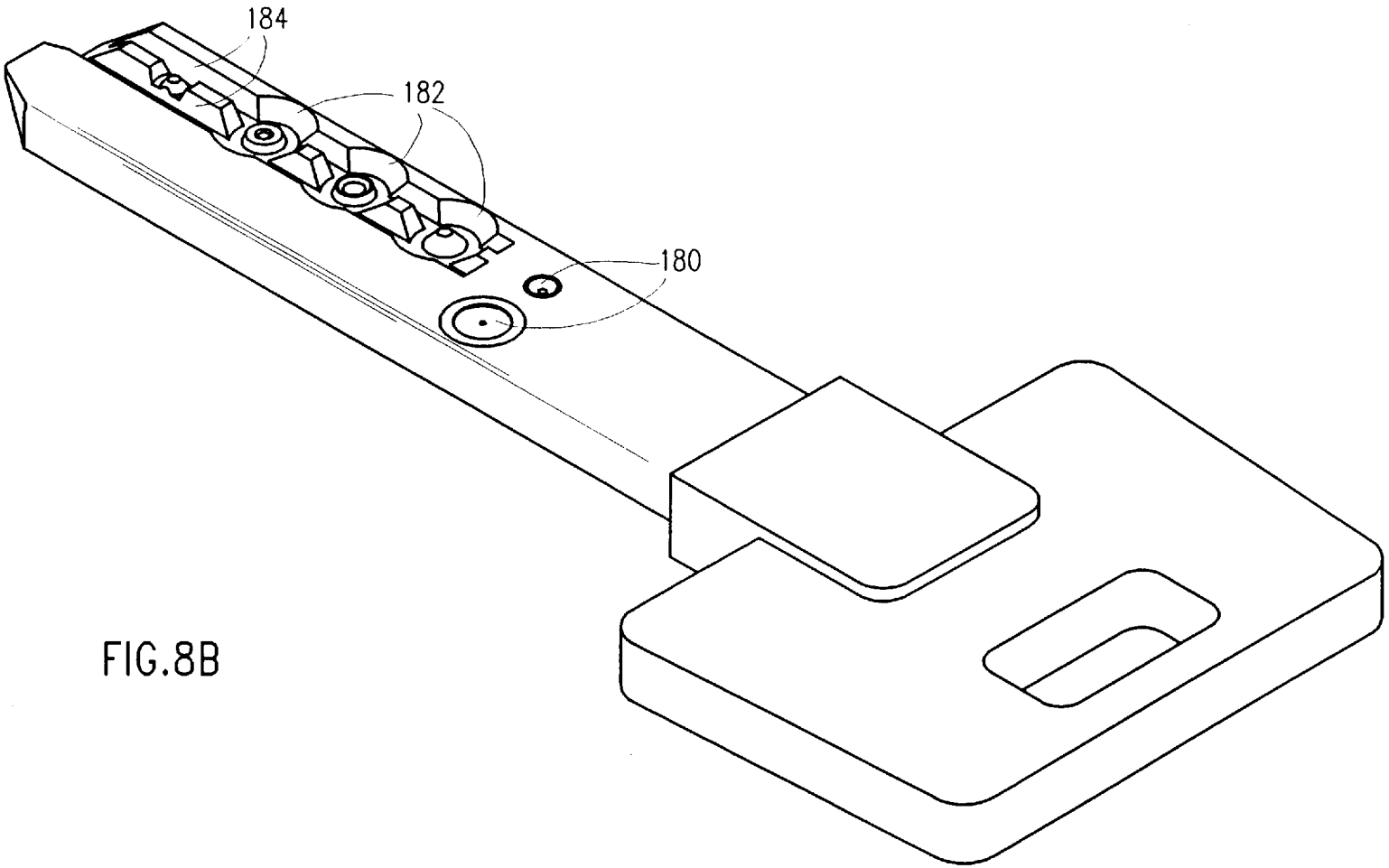

Reference is now made to FIGS. 8A and 8B which illustrate an alternative embodiment of the key blank and key of FIGS. 2A and 2B wherein the movable pins 180 are located beyond the normal key cuts 182 and keyway engaging guides 184. In such a case, an additional plug pin and housing pin (not shown) must be provided for being operated by the movable pin.

It is a particular feature of the present invention that the configuration of the plug pin engagement surface of the movable pin may be selectable configured either as part of the manufacture of the key blank, or thereafter, when the key cuts are being made. In the latter case, the same machinery used for cutting the remaining key cuts can be employed for configuring the plug pin engagement surface of the movable pin element. This is made possible by impeding rotation of the movable pin, as is illustrated in FIGS. 9–13C.

Figure 9:
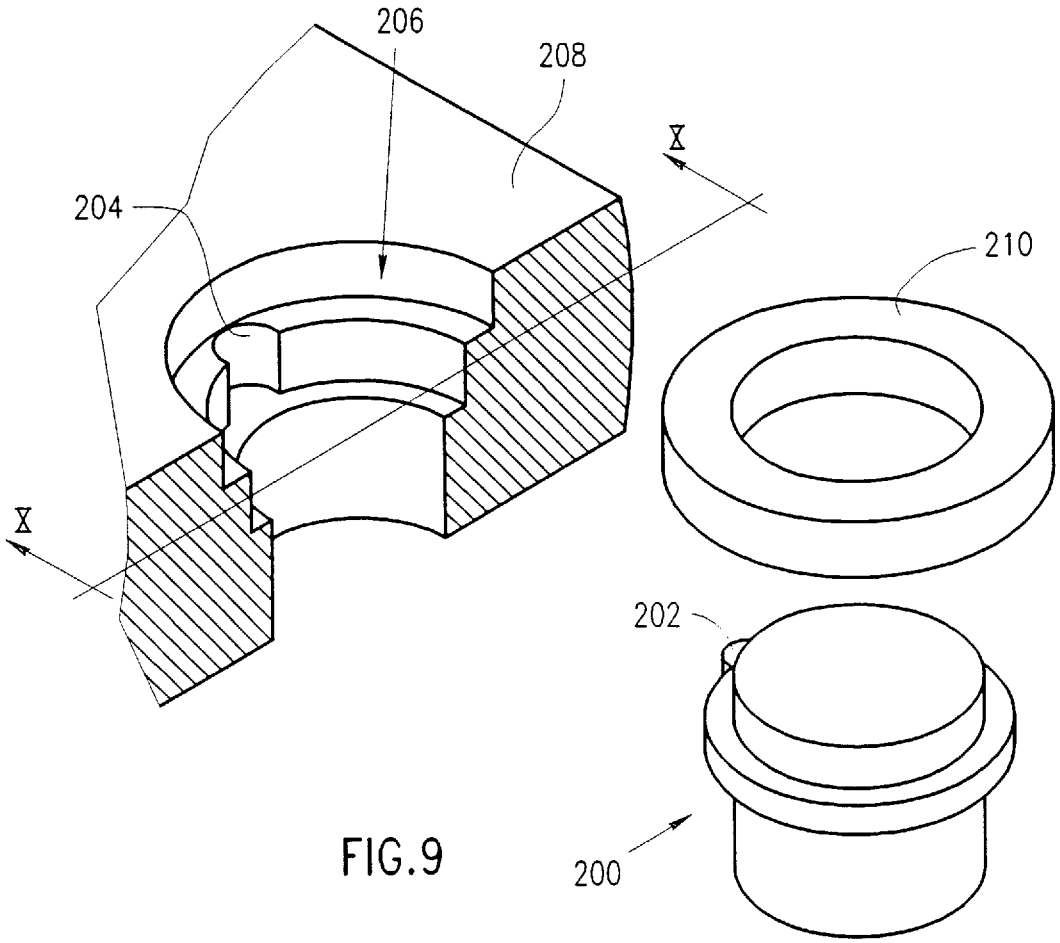
Fig. 9 is an illustration of a disassembled non-rotatable movable pin assembly, constructed and operative in accordance with a preferred embodiment of the present invention, and particularly useful for pin configuration with conventional key cutting devices.
Figure 10:
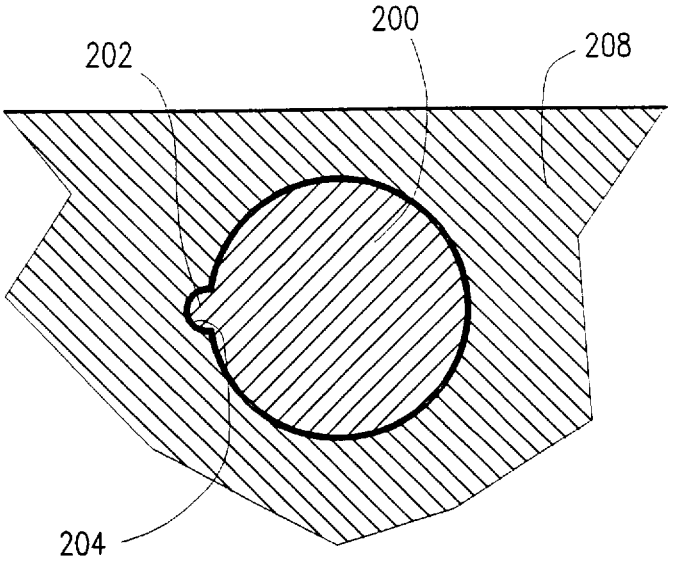
FIG. 10 is a sectional illustration of the assembly of FIG. 9 taken along the lines X—X in FIG. 9.

Reference is now made to FIGS. 9–13C which illustrate the construction and mounting of a non-rotatable movable pin element in a key blank. As seen in FIGS. 9 and 10, a movable pin element 200 may be generally identical to pin element 41 of FIG. 3A with the additional provision of a radially extending protrusion 202 which seats in a corresponding recess 204 in a bore 206 formed in the key blank shaft 208. The movable plug may be retained, similarly to the embodiment of FIG. 3A, by a retaining ring 210 in press-fit engagement with a portion of bore 206.

Figure 11:
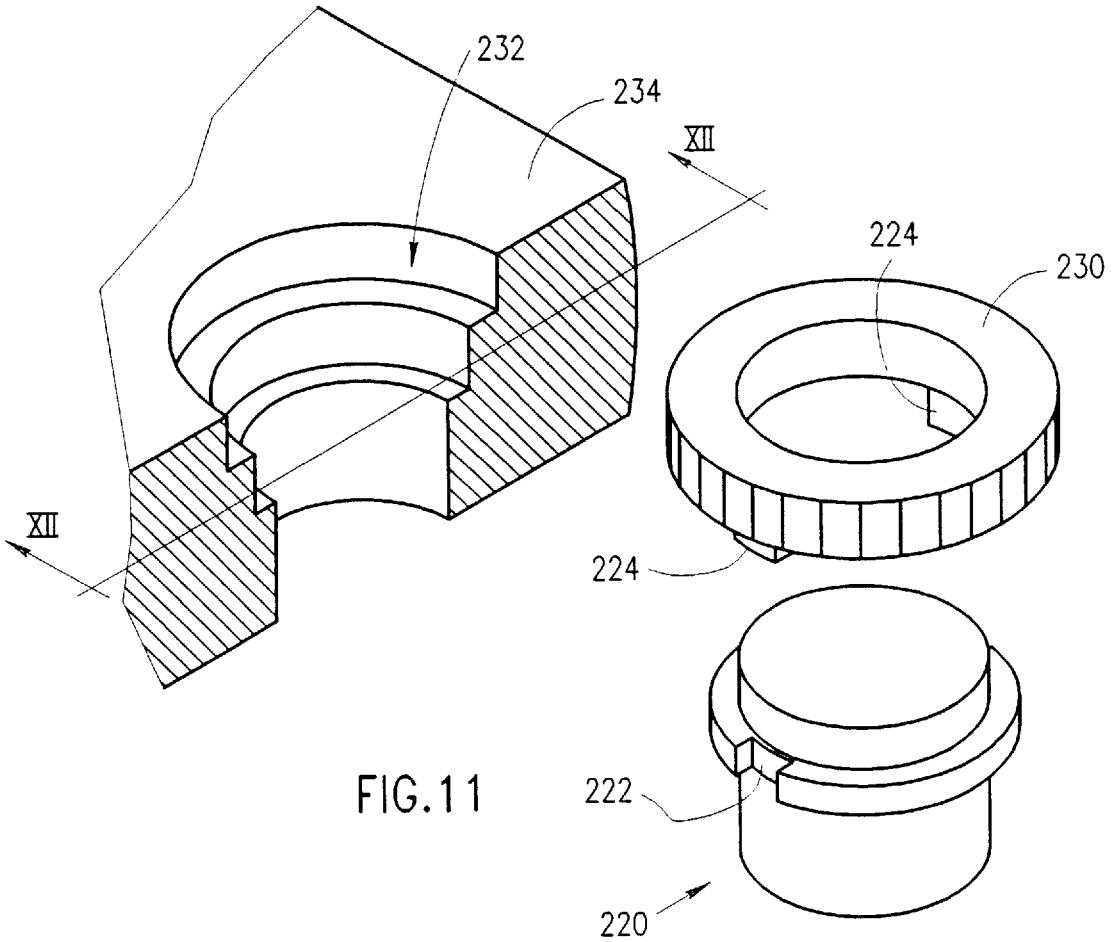
FIG. 11 is an illustration of a disassembled non-rotatable movable pin assembly, constructed and operative in accordance with another preferred embodiment of the present invention, and particularly useful for pin configuration with key cutting apparatus.
Figure 12:
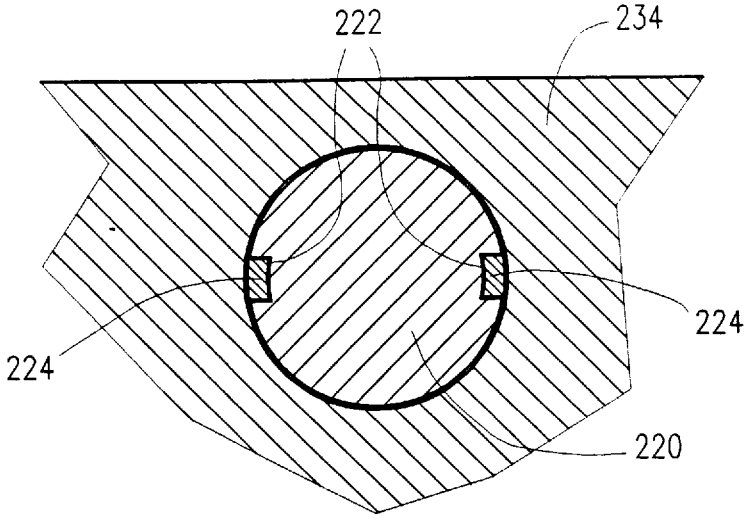
FIG. 12 is a sectional illustration of the assembly of FIG. 11 taken along the lines XII—XII in FIG. 11.

According to an alternative embodiment of the present invention, as seen in FIGS. 11 and 12, a movable pin element 220 may be generally identical to pin element 41 of FIG. 3A with the additional provision of one or more radially extending recesses 222. The movable plug is retained against rotation by a retaining ring 230, which is formed with protrusions 224 which corresponding to and seat in recesses 222, which is held in non-rotatable press-fit engagement with a portion of a bore 232 in a key blank shaft 234.

Figure 13A:
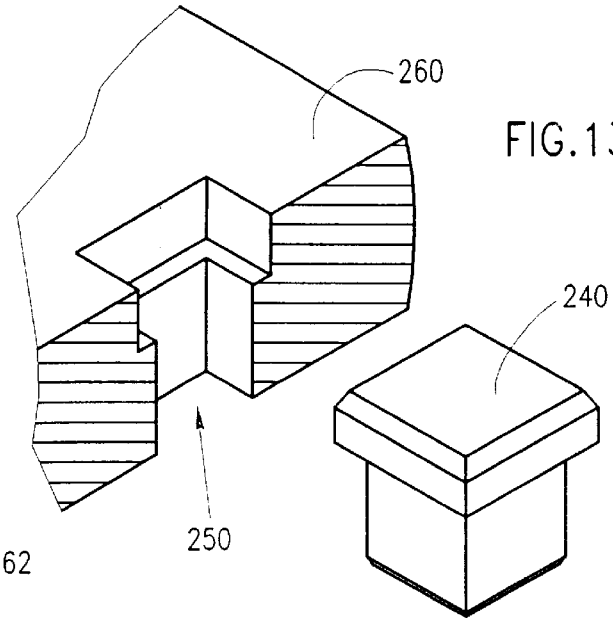
FIGS. 13A, 13B and 13C are illustrations of three different non-rotatable pin configurations useful in accordance with a preferred embodiment of the present invention.
Figure 13B:
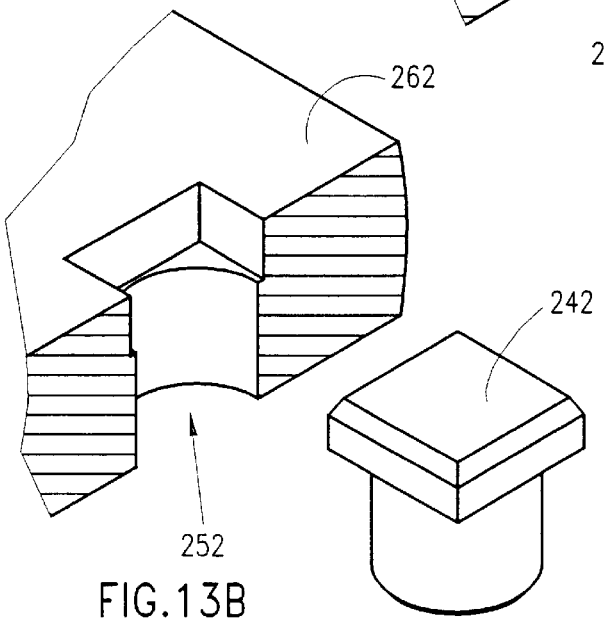
Figure 13C:
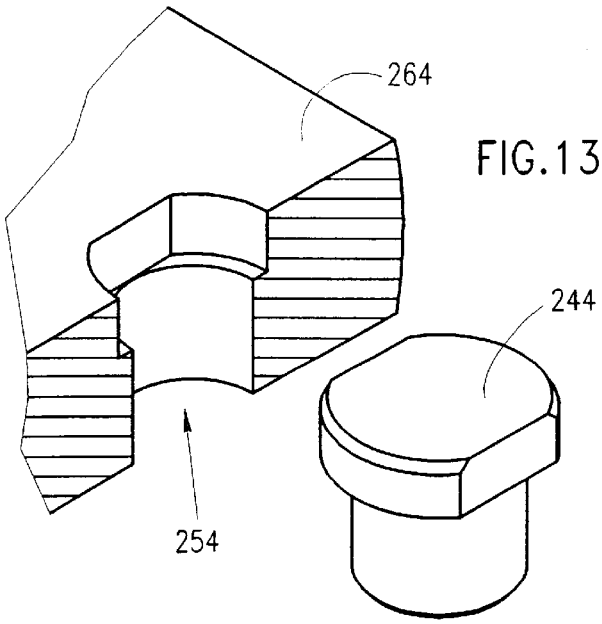

FIGS. 13A, 13B and 13C illustrate three additional illustrative examples of non-rotating movable pin elements, indicated by reference numerals 240, 242 and 244 which may be retained in a corresponding suitably shaped bore 250, 252 and 254 in corresponding key blank shaft portions 260, 262 and 264. The pin elements of FIGS. 13A–13C are typically retained against disengagement by swaging of the respective bores.

It is to be appreciated that any suitable type of non-rotating movable pin elements may be employed. Their configuration and mounting is not limited by the examples provided herein.

Figure 14A:
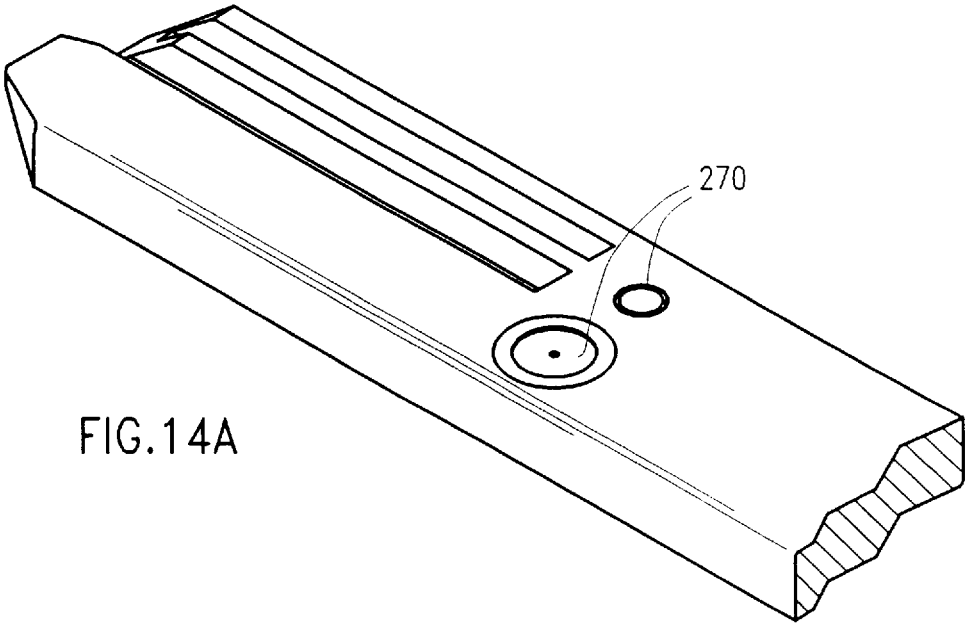
FIGS. 14A and 14B are illustrations of a key blank and key respectively, having non-rotatable movable pins.
Figure 14B:
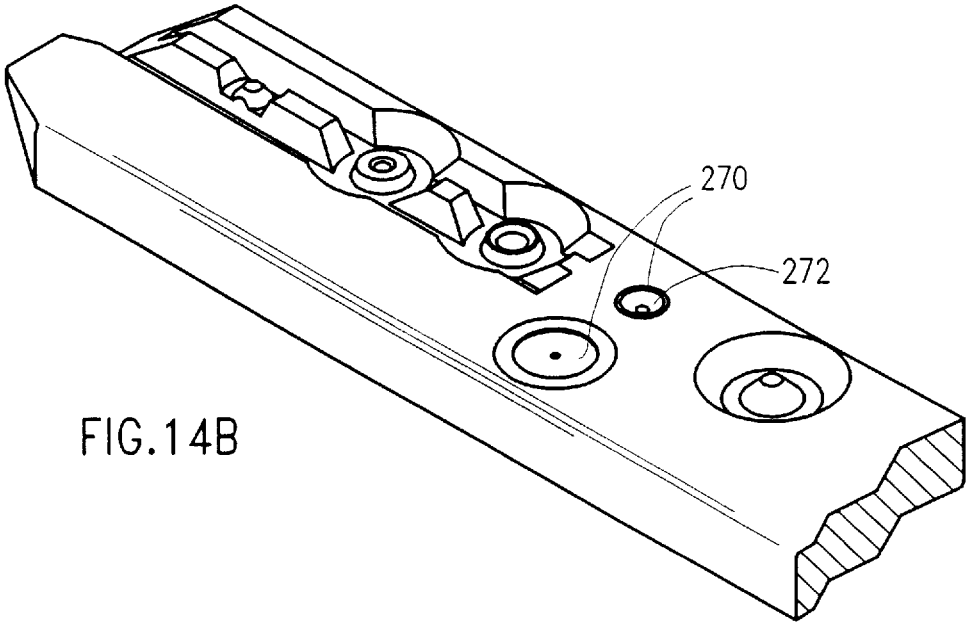

Reference is now made to FIGS. 14A and 14B, which illustrate a key blank constructed and operative in accordance with an embodiment of the present invention and employing non-rotating movable pins 270 before and after grooving by using a conventional key cutting machine. It is seen that key cuts 272 are formed in the plug pin engaging surfaces of the movable pins 270.

Figure 15A:
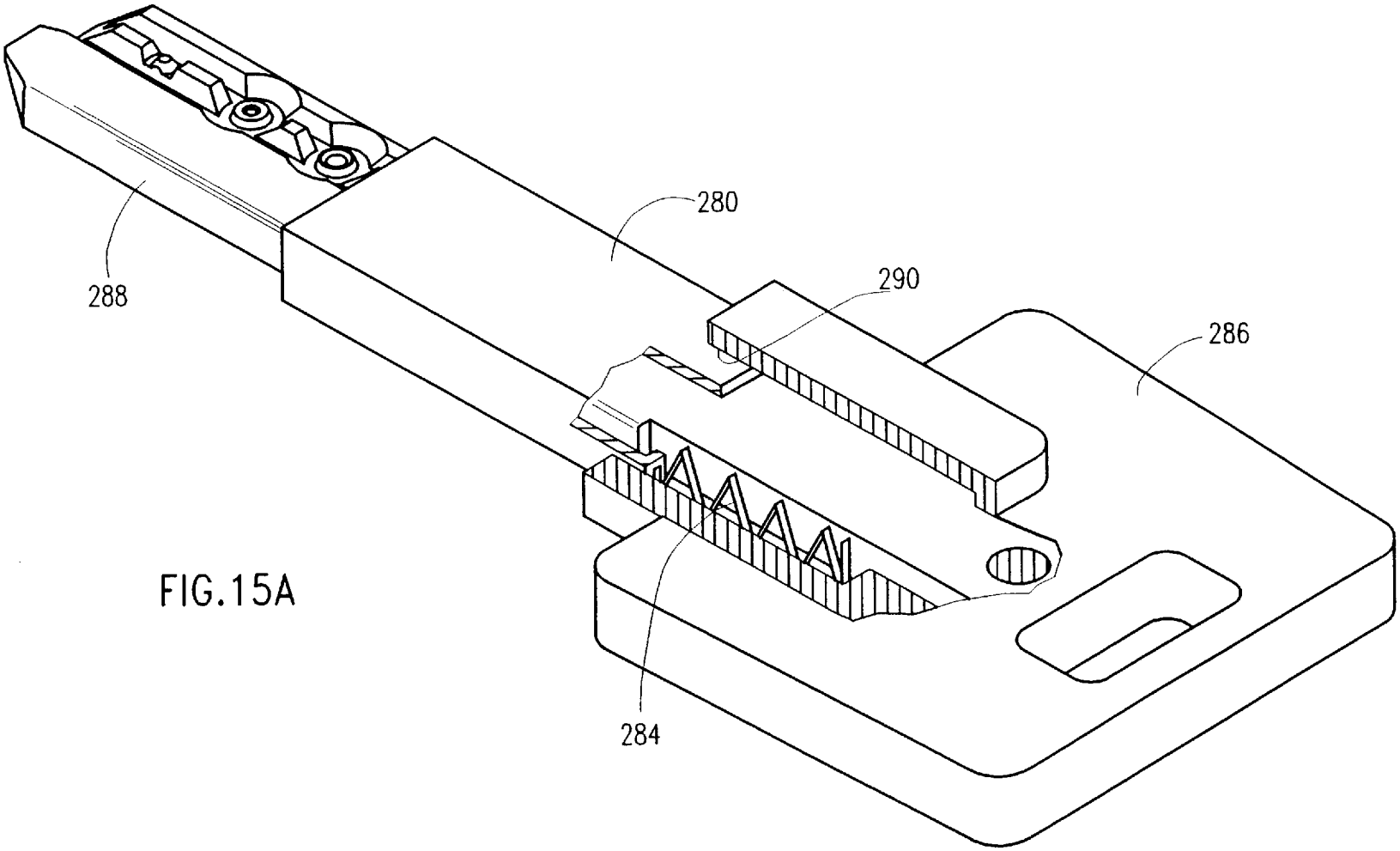
FIGS. 15 and 15B are illustrations of a key having a retractable sleeve in accordance with a preferred embodiment of the invention in respective extended and retracted orientations.
Figure 15B:
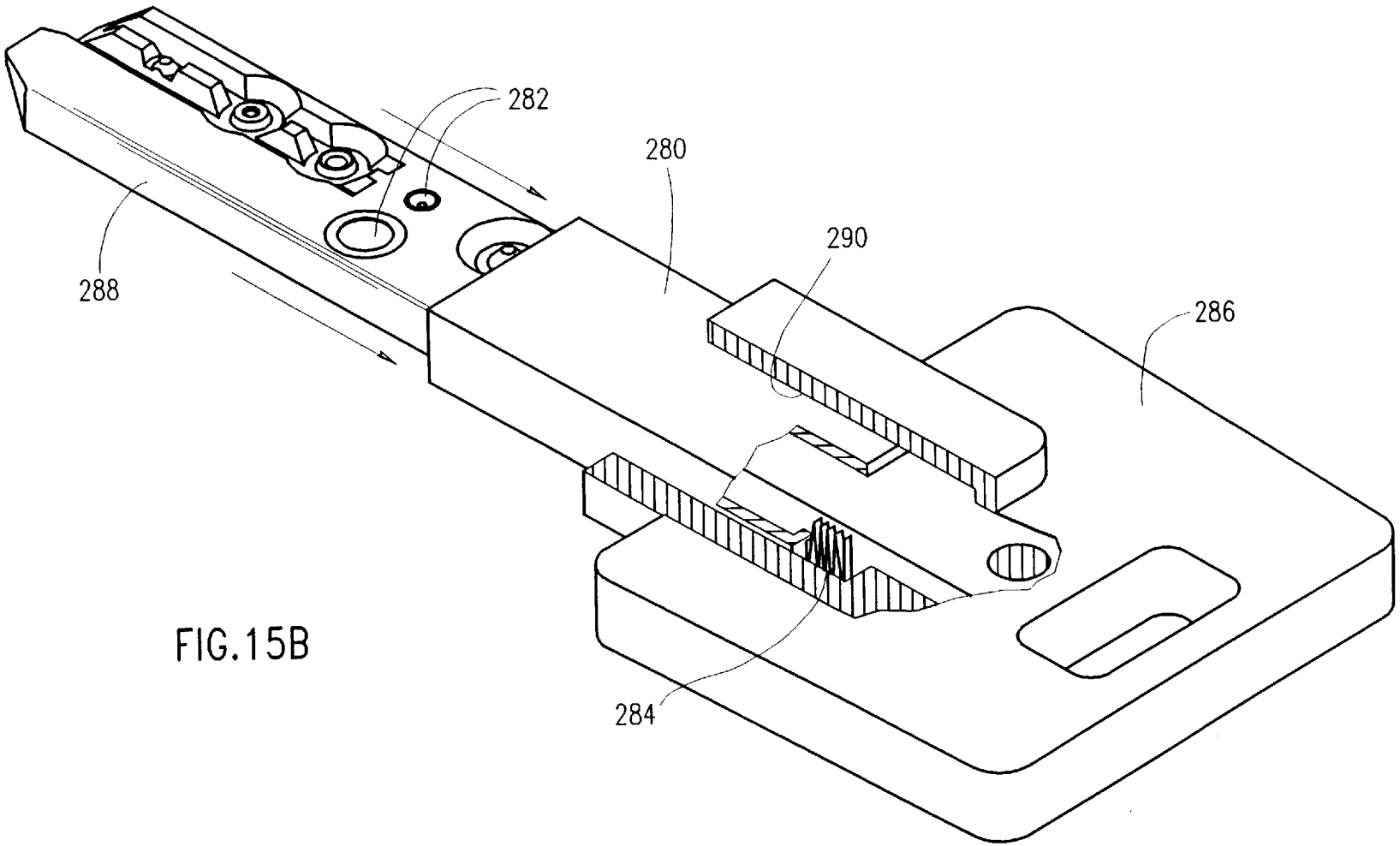

Reference is now made to FIGS. 15A and 15B which illustrate a key of the type described above and also having formed therein a retractable cover sleeve 280 for providing protection of the key cuts and particularly the movable pin elements 282 against ingress of spurious materials or damage which could impede their proper operation.

In the embodiment of FIGS. 15A and 15B a compression spring 284 is operative to urge sleeve 280 forward away from a molded key head 286 and over shaft portion 288. The sleeve 280 is retracted into a recess 290 formed into the key head 286 when the key is inserted into a keyway by engagement with the front surface of the plug. It is to be appreciated that normally key blanks are to be manufactured with the sleeve 280 and spring 284 prior to cutting of the key and thus the key blanks made in this way are also within the scope of the present invention.

It will be appreciated by persons skilled in the art that the present invention is not limited by what has been particularly shown and described hereinabove. Rather the scope of the present invention is defined only by the claims which follow:

We claim:

1. A key and lock combination, the key comprising:

a generally-elongate shaft portion extending along a shaft axis and defining first and second generally flat oppositely-directed side surfaces, joined by edge surfaces narrower than said side surfaces, said first side surface defining a first key combination surface and a row of key cuts which define a key combination; and at least one first movable pin element retained within the elongate shaft portion, said at least one first movable pin element extending along a first movable pin axis, said first movable pin axis being perpendicular to said shaft axis and intersecting an axis along which extends said row of key cuts, wherein said at least one movable pin element extends from said first side surface to said second side surface and is displaced axially along said first movable pin axis from said second side surface inwardly towards said first side surface, such that when said at least one first movable pin element is recessed with respect to said second side surface it protrudes outwardly from said first side surface along said row of key cuts, and wherein said at least one movable pin element comprises a plug pin engaging portion having a face end formed with a socket of a desired depth and with a shoulder, wherein said plug pin engaging portion is engageable with a pair of telescoping pins, wherein said socket is adapted to abut one of said telescoping pins and said shoulder is adapted to abut the other of said telescoping pins; and the lock comprising:

a housing;

a plug disposed in the housing, arranged for rotation relative thereto and defining a keyway;

a first plurality of chambers formed in the housing and a second plurality of chambers formed in the plug on one side of the keyway and being arranged such that each one of the first plurality of chambers extends coaxially with a corresponding one of the second plurality of chambers, when the plug is in a first rotational orientation relative to the housing;

wherein first pin assemblies are disposed in the first plurality of chambers and second pin assemblies are disposed in the second plurality of chambers, said first pin assemblies each being displaceable along a first pin assembly axis and said second pin assemblies each being displaceable along a second pin assembly axis; and a third pin assembly is disposed in the plug on a side of the keyway opposite to that of the second pin assemblies and facing one of the second pin assemblies and is operative to urge said at least one first movable pin element axially outwardly from the key into engagement with one of the second pin assemblies, said third pin assembly being displaceable along a third pin assembly displacement axis which is coaxial with one of said second pin assembly axes.

2. A key comprising:

a generally-elongate shaft portion extending along a shaft axis and defining first and second generally flat oppositely-directed side surfaces, joined by edge surfaces narrower than said side surfaces, said first side surface defining a first key combination surface and a row of key cuts which define a key combination; and at least one first movable pin element retained within the elongate shaft portion, said at least one first movable pin element extending along a first movable pin axis, said first movable pin axis being perpendicular to said shaft axis and intersecting an axis along which extends said row of key cuts, wherein said at least one movable pin element extends from said first side surface to said second side surface and is displaced axially along said first movable pin axis from said second side surface inwardly towards said first side surface, such that when said at least one first movable pin element is recessed with respect to said second side surface it protrudes outwardly from said first side surface along said row of key cuts, and wherein said at least one movable pin element comprises a plug pin engaging portion having a face end formed with a socket of a desired depth and with a shoulder, wherein said plug pin engaging portion is engageable with a pair of telescoping pins, wherein said socket is adapted to abut one of said telescoping pins and said shoulder is adapted to abut the other of said telescoping pins.

3. A key comprising:

a generally-elongate shaft portion extending along a shaft axis and defining first and second generally flat oppositely-directed side surfaces, joined by edge surfaces narrower than said side surfaces, said first side surface defining a first key combination surface and a row of key cuts which define a key combination; and at least one first movable pin element retained within the elongate shaft portion, said at least one first movable pin element extending along a first movable pin axis, said first movable pin axis being perpendicular to said shaft axis and intersecting an axis along which extends said row of key cuts, wherein said at least one movable pin element extends from said first side surface to said second side surface and is displaced axially along said first movable pin axis from said second side surface inwardly towards said first side surface, such that when said at least one first movable pin element is recessed with respect to said second side surface it protrudes outwardly from said first side surface along said row of key cuts, and wherein said second side surface also defines a second key combination surface and a second row of key cuts which defines a key combination; and at least one second movable pin element extends along a second movable pin axis, said second movable pin axis being perpendicular to said shaft axis and intersecting an axis along which extends said second row of key cuts, wherein said at least one second movable pin element extends from said first side surface to said second side surface and is displaced axially along said second movable pin axis inwardly towards said second side surface, such that when said at least one second movable pin element is recessed with respect to said first side surface, it protrudes outwardly from said second side surface.

4. A key according to claim 3 and wherein said at least one first movable pin element is selectably configured to define part of a key combination.

5. A key according to claim 3 and wherein said first and second key combination surfaces are laterally offset one from the other and wherein said first and second movable pin elements are laterally offset one from the other.

6. A key according to claim 3 and wherein said at least one first movable pin element is retained within the elongate shaft portion at a location intersecting said row of key cuts, so that it cannot protrude from said second side surface.

7. A key according to claim 3 and wherein said at least one first movable pin element is retained within the elongate shaft portion at a location intersecting said row of key cuts, so that it cannot protrude from said second side surface.

8. A key according to claim 3 and wherein said at least one second movable pin element is selectably configured to define part of a key combination.

9. A key and lock combination, the key comprising:

a generally-elongate shaft portion extending along a shaft axis and defining first and second generally flat oppositely-directed side surfaces, joined by edge surfaces narrower than said side surfaces, said first side surface defining a first key combination surface and a row of key cuts which define a key combination; and at least one first movable pin element retained within the elongate shaft portion, said at least one first movable pin element extending along a first movable pin axis, said first movable pin axis being perpendicular to said shaft axis and intersecting an axis along which extends said row of key cuts, wherein said pin element extends from said first side surface to said second side surface and is displaced axially along said first movable pin axis from said second side surface inwardly towards said first side surface, such that when said at least one first movable pin element is recessed with respect to said second side surface it protrudes outwardly from said first side surface along said row of key cuts, and wherein said second side surface also defines a second key combination surface and a second row of key cuts which defines a key combination; and at least one second movable pin element extends along a second movable pin axis, said second movable pin axis being perpendicular to said shaft axis and intersecting an axis along which extends said second row of key cuts, wherein said at least one second movable pin element extends from said first side surface to said second side surface and is displaced axially along said second movable pin axis inwardly towards said second side surface, such that when said at least one second movable pin element is recessed with respect to said first side surface, it protrudes outwardly from said second side surface, the lock comprising:

a housing;

a plug disposed in the housing, arranged for rotation relative thereto and defining a keyway;

a first plurality of chambers formed in the housing and a second plurality of chambers formed in the plug on one side of the keyway and being arranged such that each one of the first plurality of chambers extends coaxially with a corresponding one of the second plurality of chambers, when the plug is in a first rotational orientation relative to the housing;

wherein first pin assemblies are disposed in the first plurality of chambers and second pin assemblies are disposed in the second plurality of chambers, said first pin assemblies each being displaceable along a first pin assembly axis and said second pin assemblies each being displaceable along a second pin assembly axis; and a third pin assembly is disposed in the plug on a side of the keyway opposite to that of the second pin assemblies and facing one of the second pin assemblies and is operative to urge said at least one first movable pin element axially outwardly from the key into engagement with one of the second pin assemblies, said third pin assembly being displaceable along a third pin assembly displacement axis which is coaxial with one of said second pin assembly axes.

10. A lock and key combination according to claim 9 and wherein said third pin assembly comprises a spring loaded pin.

11. A lock and key combination according to claim 9 and wherein said at least one first movable pin element is retained within the elongate shaft portion at a location intersecting said axis along which extends said row of key cuts, so that it cannot protrude from said second side surface.

* * * * *